US005839788A

United States Patent [19]

Orr, III

[11] Patent Number: 5,839,788

[45] Date of Patent: Nov. 24, 1998

[54] ARTICLE OF FURNITURE WITH AN IMPROVED INNER SUPPORT SYSTEM

[75] Inventor: Moses Orr, III, 701 B Temple Rd., Ladson, S.C. 29456

[73] Assignee: Moses Orr, III, Ladson, S.C.

[21] Appl. No.: 805,919

[22] Filed: Mar. 4, 1997

[51] Int. Cl.[6] ..... A47C 7/74

[52] U.S. Cl. ..... 297/452.41; 297/180.12; 297/180.15; 5/422; 5/685

[58] Field of Search ..... 297/180.1, 180.12, 297/180.15, 432.41; 5/685, 422, 668, 699, 700; 607/104

[56] References Cited

U.S. PATENT DOCUMENTS

| | | | |
|---|---|---|---|
| 3,960,145 | 6/1976 | Scarbrough | 128/68.1 |
| 4,258,706 | 3/1981 | Shank | 297/180.12 |
| 4,738,486 | 4/1988 | Surber | 297/180.12 |
| 4,966,413 | 10/1990 | Palarski | 297/284.6 |
| 4,969,684 | 11/1990 | Zarotti | 297/180.12 |
| 5,146,633 | 9/1992 | Kim et al. | 5/421 |
| 5,259,379 | 11/1993 | Kim et al. | 607/104 |
| 5,433,741 | 7/1995 | Truglio | 607/104 |
| 5,516,189 | 5/1996 | Ligeras | 297/180.12 |

*Primary Examiner*—Milton Nelson, Jr.
*Assistant Examiner*—Anthony D. Barfield
*Attorney, Agent, or Firm*—David L. Volk

[57] ABSTRACT

A plurality of flexible enclosures are disposed within an article of furniture. The enclosures are positioned to receive the weight of a person resting on the furniture. The enclosures contain a liquid such as water therein. A plurality of electric coils are positioned within the furniture. Each electric coil is within a water-resistant cover, and each cover is positioned adjacent to one of the enclosures. The coils are electrically connected to a controller for changing heat output from the coils, and the coils are electrically connectable to a power source. A water-resistant liner is positioned generally beneath the enclosures. Cushioning material is positioned generally beneath the liner. Foam padding is positioned generally above the enclosures.

12 Claims, 4 Drawing Sheets

ARTICLE OF FURNITURE WITH AN IMPROVED INNER SUPPORT SYSTEM

BACKGROUND OF THE INVENTION

1. Field of the Invention

The present invention relates to furniture, particularly to inner support systems for furniture.

2. Description of the Related Art

Persons with backaches or sore muscles, and persons in need of relaxation, need a comfortable, supportive chair, lounge or recliner in which to rest and recuperate. Until the present invention, there has been no chair, lounge or recliner with a water-filled inner support system and a system for heating the water. Such a system would be beneficial in that the heated water could provide a source of therapeutic comfort and bodily support for persons sitting, lying or reclining on the furniture.

SUMMARY OF THE INVENTION

The article of furniture of the present invention includes a plurality of flexible enclosures within the furniture. The enclosures are positioned to receive the weight of a person resting on the furniture. The enclosures contain a liquid such as water therein. A plurality of electric coils are positioned within the furniture. Each electric coil is within a water-resistant cover, and each cover is positioned adjacent to one of the enclosures. The coils are electrically connected to a controller for changing heat output from the coils, and the coils are electrically connectable to a power source. A water-resistant liner is positioned generally beneath the enclosures. Cushioning material is positioned generally beneath the liner. Foam padding is positioned generally above the enclosures.

DETAILED DESCRIPTION

Figure 1:
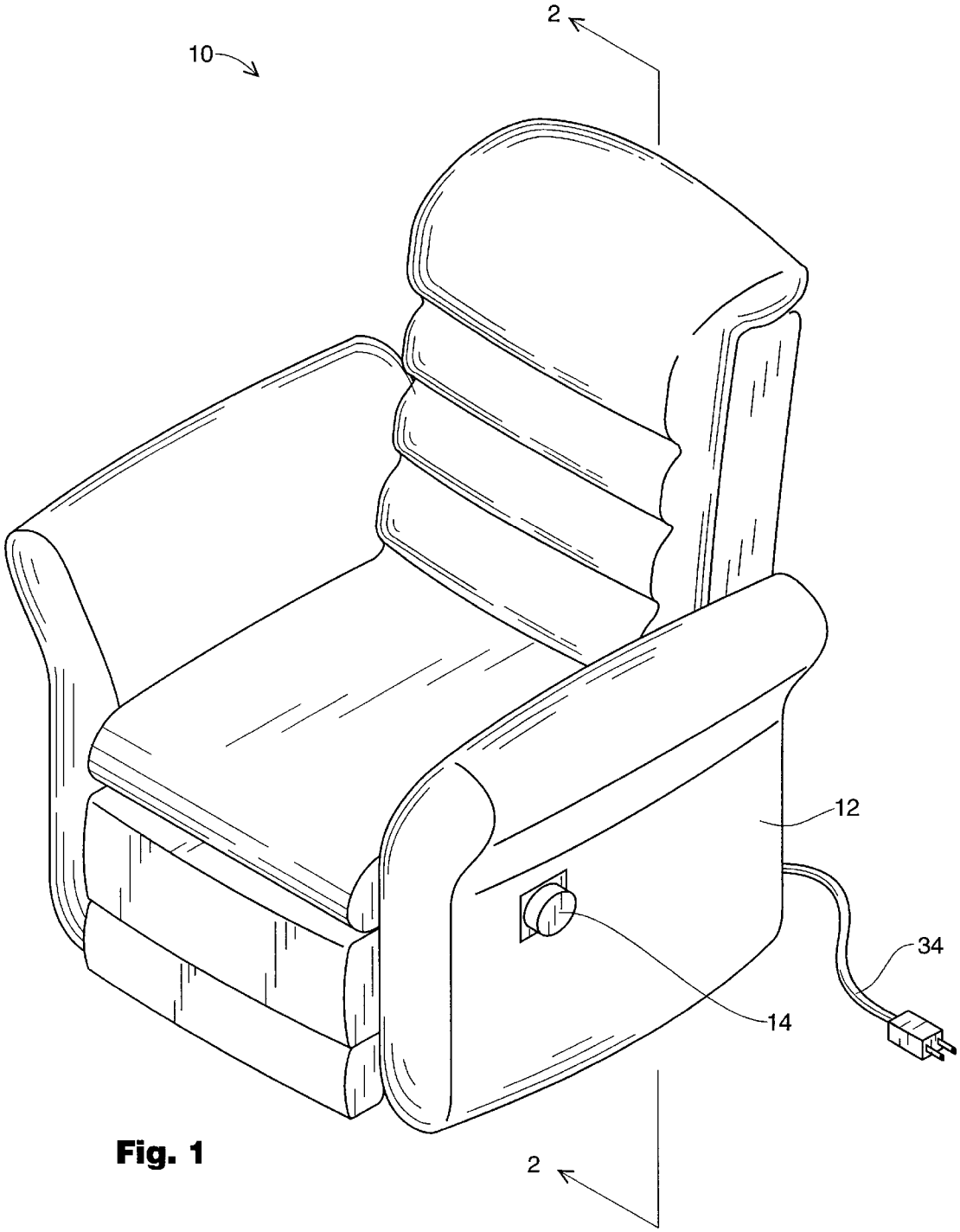
FIG. 1 is a perspective view of a recliner.

FIG. 1 is a perspective view of the article of furniture of the present invention. In this particular embodiment, the article of furniture is a recliner 10. Other articles of furniture on which a person may rest are within the scope of the present invention, including but not limited to chairs, sofas, couches, and lounge chairs. On a side 12 of the recliner 10, in a position accessible to a user (not shown) seated on the recliner 10, is a controller 14. In this particular embodiment, the controller 14 is in the form of a knob; however, other types of controllers are within the scope of the present invention, including but not limited to switches, buttons, and sliding mechanisms. The controller 14 is used to control the amount of heat provided to a user seated on the recliner 10, in a manner which will be set forth later herein.

Figure 2:
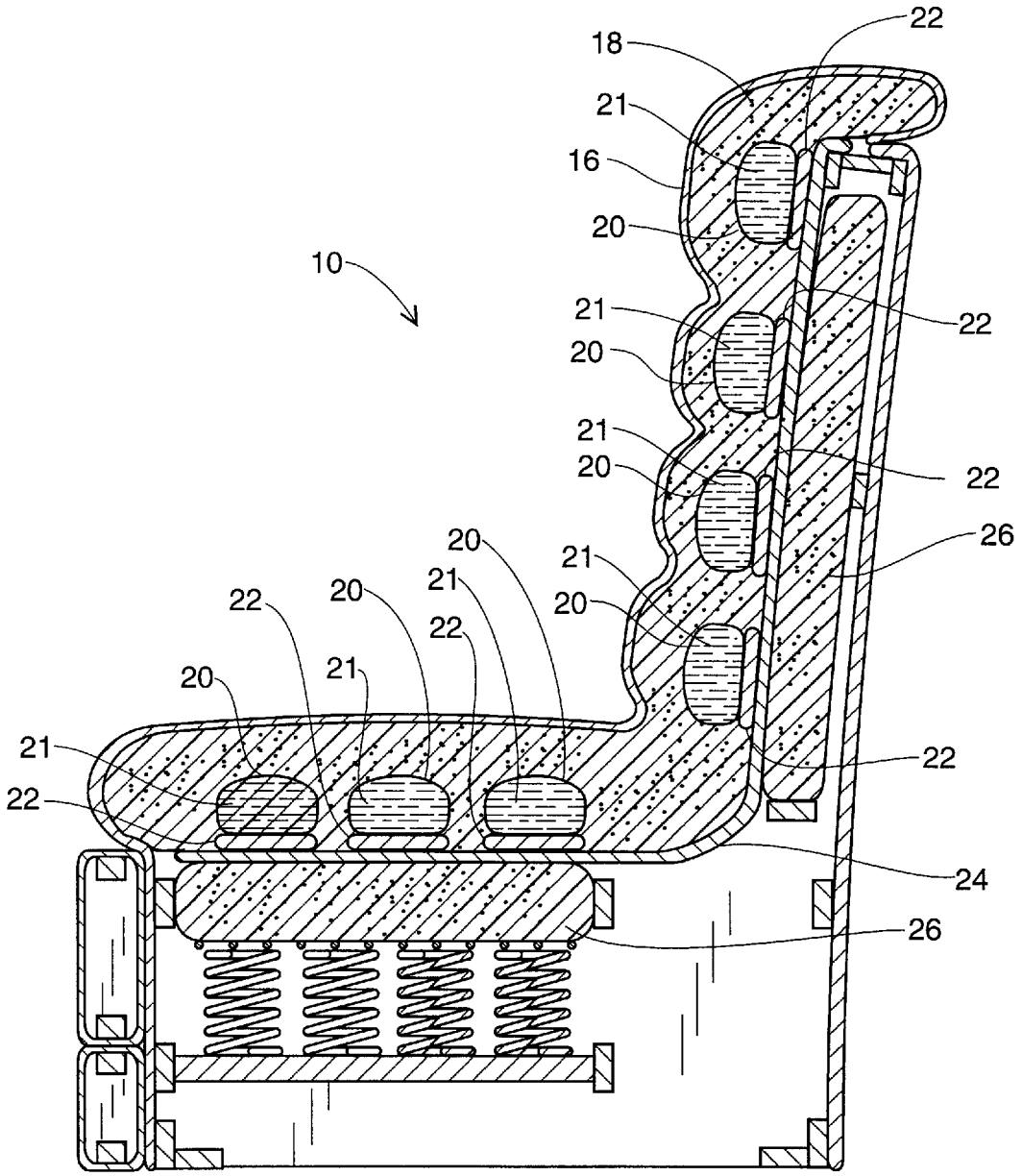
FIG. 2 is a cross-sectional view taken along line 2—2 of FIG. 1.
Figure 3:
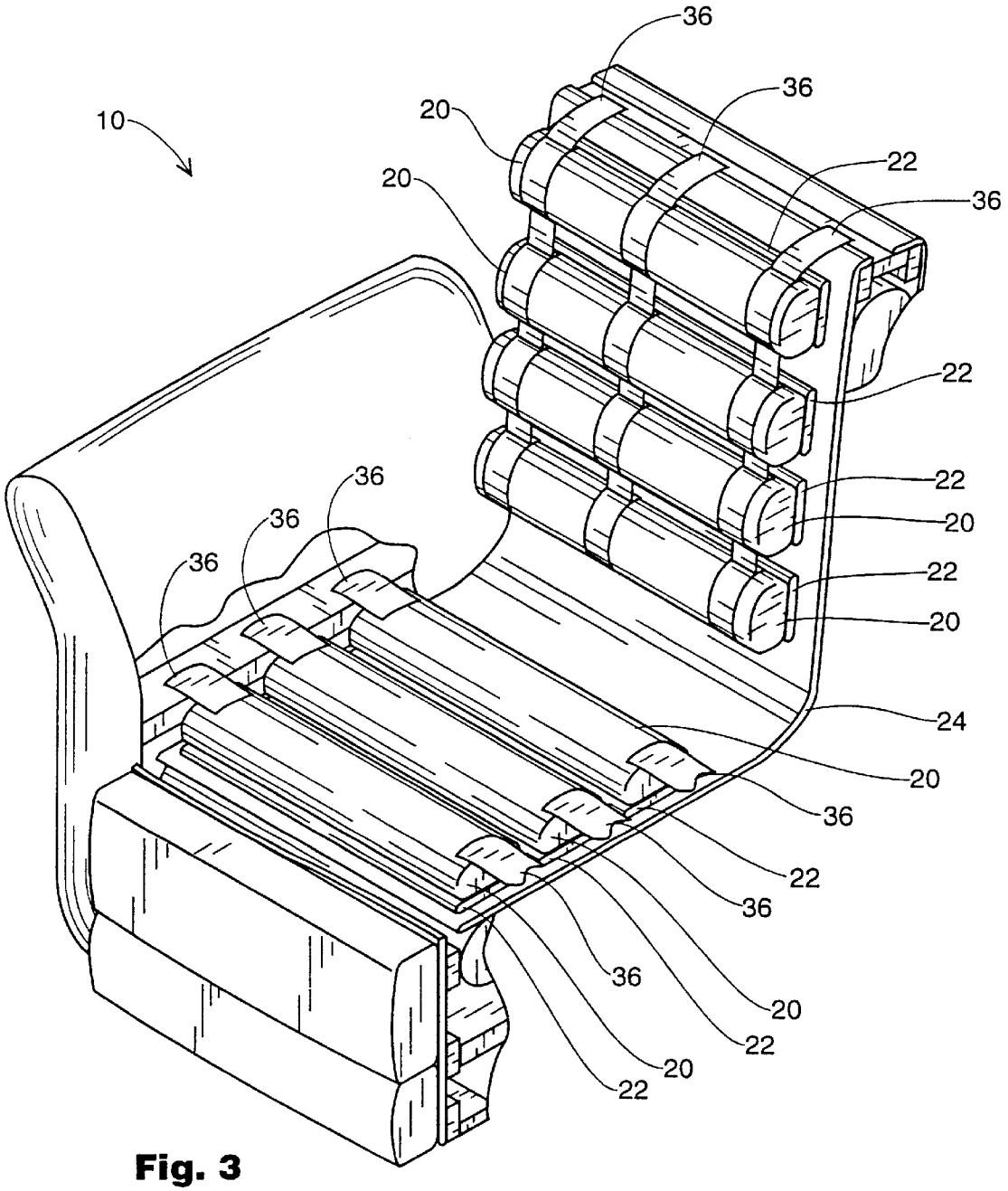
FIG. 3 is a partial perspective view of the recliner, with portions of the recliner removed to show structure beneath and behind the foam padding.

FIG. 2 is a cross-sectional view taken along line 2—2 of FIG. 1. FIG. 3 is a partial perspective view of the recliner 10, with portions of the recliner 10 removed to show structure beneath and behind foam padding 18. Referring to both FIGS. 2 and 3, a plurality of flexible enclosures 20 are disposed within the recliner 10. The enclosures 20 are positioned to receive the weight of a person (not shown) resting on the recliner 10. The enclosures 20 contains a conventional, well known heat transfer medium 21 such as water, gel or other liquid therein. The heat transfer medium 21 is chosen not only for its heat retaining and transfer properties, but also for its cushioning and comforting effect on a person (not shown) resting on the recliner 10. The enclosures 20 may be made of any conventional, suitable material for containing the heat transfer medium 21 therein, such as vinyl or rubber. The enclosures 20 are supported from the frame of the recliner 10 by straps 36. Any conventional method of supporting the enclosures 20 within the recliner 10 is within the scope of the present invention.

The foam padding 18 is positioned generally above the enclosures 20, to provide cushioning between a person resting on the recliner and the enclosures 20. The foam padding 18 is covered with an outer covering 16 which may be any conventional furniture covering such as fabric or vinyl.

A plurality of heat pads 22 are positioned within the recliner 10. Each heat pad 22 is positioned adjacent to one of the enclosures 20, so that the heat pad 22 may provide heat to the heat transfer medium 21 within the enclosure 20. A water-resistant liner 24 is positioned generally beneath the enclosures 20. Cushioning material 26 is positioned generally beneath the liner 24. The liner 24 helps to protect the cushioning material 26 from damage. The cushioning material 26 provides additional user comfort and helps to protect the heat pads 22 and the enclosures 20.

Figure 4:
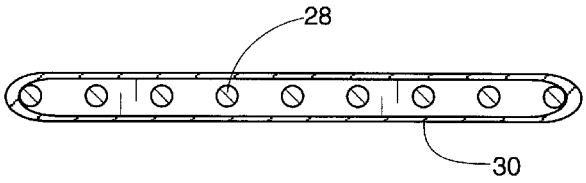
FIG. 4 is a cross-sectional view of a heat pad.
Figure 5:
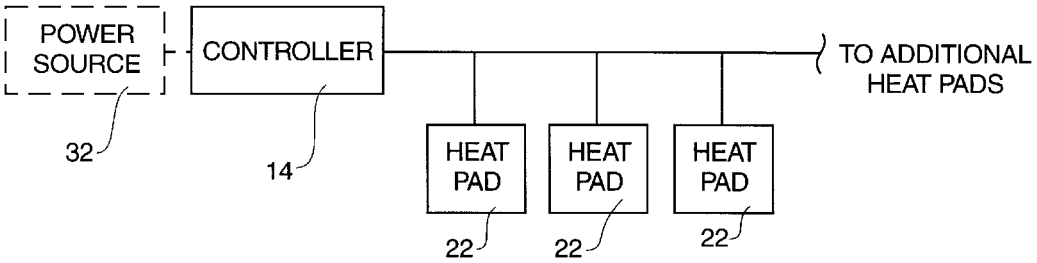
FIG. 5 is a block schematic diagram of a system of providing heat to the heat pads.

FIG. 4 is a cross-sectional view of the heat pad 22, and FIG. 5 is a block schematic diagram of a system of providing heat to the heat pads 22. Referring to both FIGS. 4 and 5, each of the heat pads 22 comprises an electric coil 28 within a water-resistant cover 30. The cover 30 may be a vinyl coated fabric or other suitable material or combination of materials, designed to withstand heat from the coil 28, to be water-resistant, and to transmit heat from the coil 28 to the heat transfer medium 21 within the enclosures 20. The coils 28 are electrically connected to the controller 14 for changing heat output from the coils 28. The controller 14 varies the heat output from the coils 28 in any conventional manner well known in the art. The coils 28 are electrically connectable to a power source. Referring back to FIG. 1, this is accomplished with a standard AC cord 34.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention, for example: a means could be provided for filling and emptying the enclosures 20; and the enclosures 20 may be made removable from the recliner 10. Accordingly, the scope of the invention is to be limited only by the following claims and their legal equivalents.

The invention claimed is:

1. An article of furniture comprising:

a. at least one flexible enclosure within the furniture and positioned for receiving weight of a person resting on the furniture;

b. the enclosure containing a liquid therein;

c. a heating element within a cover the cover positioned adjacent the enclosure;

d. a water-resistant liner positioned generally beneath the cover and generally beneath the enclosure when the article of furniture is upright; and e. cushioning material positioned generally beneath the liner when the article of furniture is upright.

2. The article of furniture of claim 1, wherein the heating element is an electric coil, the coil is electrically connected to a control means for changing heat output from the coil, and the coil is electrically connectable to a power source.

3. The article of furniture of claim 2, wherein the cover is water-resistant.

4. The article of furniture of claim 1, further comprising foam padding positioned generally above the enclosure when the article of furniture is upright.

5. A chair comprising:

a. a back rest and a seat;

b. a plurality of flexible enclosures within the back rest and within the seat, the enclosures positioned for receiving weight of a person resting on the furniture;

c. the enclosures containing a liquid therein;

d. a plurality of covers, each cover containing a heating element therein, each cover positioned adjacent to one of the enclosures;

e. a water-resistant liner positioned generally beneath the covers and generally beneath the enclosures when the article of furniture is upright; and f. cushioning material positioned generally beneath the liner when the article of furniture is upright.

6. The article of furniture of claim 5, wherein the heating elements are electric coils, the coils are electrically connected to a control means for changing heat output from the coils, and the coils are electrically connectable to a power source.

7. The article of furniture of claim 6, wherein the covers are water-resistant.

8. The article of furniture of claim 5, further comprising foam padding positioned generally above the enclosures when the article of furniture is upright.

9. An article of furniture comprising:

a. at least one flexible enclosure within the furniture and positioned for receiving weight of a person resting on the furniture;

b. the enclosure containing a gel therein;

c. a heating element within a cover, the cover positioned adjacent to the enclosure;

d. a water-resistant liner positioned generally beneath the cover and generally beneath the enclosure when the article of furniture is upright; and e. cushioning material positioned generally beneath the liner when the article of furniture is upright.

10. The article of furniture of claim 9, wherein the heating element is an electric coil, the coil is electrically connected to a control means for changing heat output from the coil, and the coil is electrically connectable to a power source.

11. The article of furniture of claim 10, wherein the cover is water-resistant.

12. The article of furniture of claim 9, further comprising foam padding positioned generally above the enclosure when the article of furniture is upright.

* * * * *